United States Patent [19]

Ferraris

[11] Patent Number: 4,492,097

[45] Date of Patent: Jan. 8, 1985

[54] CIRCULAR KNITTING MACHINE FOR HOSIERY ARTICLES

[75] Inventor: Carlo Ferraris, Cellatica, Italy

[73] Assignee: Santoni & Co. SpA, Italy

[21] Appl. No.: 378,876

[22] Filed: May 17, 1982

[30] Foreign Application Priority Data

May 19, 1981 [IT] Italy ..... 218178/81

[51] Int. Cl.[3] ..... D04B 15/06

[52] U.S. Cl. ..... 66/108 R; 66/54

[58] Field of Search ..... 66/8, 27, 54, 108 R, 66/108 A, 217

[56] References Cited

U.S. PATENT DOCUMENTS

| | | | |
|---|---|---|---|
| 2,963,887 | 12/1960 | Page et al. | 66/54 |
| 3,243,975 | 4/1966 | Lawson et al. | 66/54 X |
| 3,587,251 | 6/1971 | Vincoli | 66/8 |
| 3,683,644 | 8/1972 | Chvala et al. | 66/8 |
| 3,783,645 | 1/1974 | Bianchi | 66/108 R |

FOREIGN PATENT DOCUMENTS

| | | | |
|---|---|---|---|
| 2031089 | 1/1971 | Fed. Rep. of Germany | 66/8 |
| 1129983 | 10/1968 | United Kingdom | 66/108 R |

*Primary Examiner*—Wm. Carter Reynolds

*Attorney, Agent, or Firm*—Shlesinger, Fitzsimmons & Shlesinger

[57] ABSTRACT

In a circular knitting machine for hosiery articles, a plurality of generally banana-shaped sinker-pressing cams are mounted beneath a lid or cap to float radially between an inner ring cam and a plurality of miniature pneumatic rams and attendant plungers, which are arranged in a circular path around the outsides of the sinker-pressing cams. Each of the rams has its plunger engaged with the outer peripheral surface of one of the sinker-pressing cams, and is connected to a pneumatic control means, which is operable selectively to force the ram plunger against the associated sinker pressing cam to urge it radially inward against the outer ends of the sinkers. With this construction the sinker-pressing cams can be selectively utilized depending upon the type of article being produced on the machine.

5 Claims, 2 Drawing Figures

Figures 1, 2:
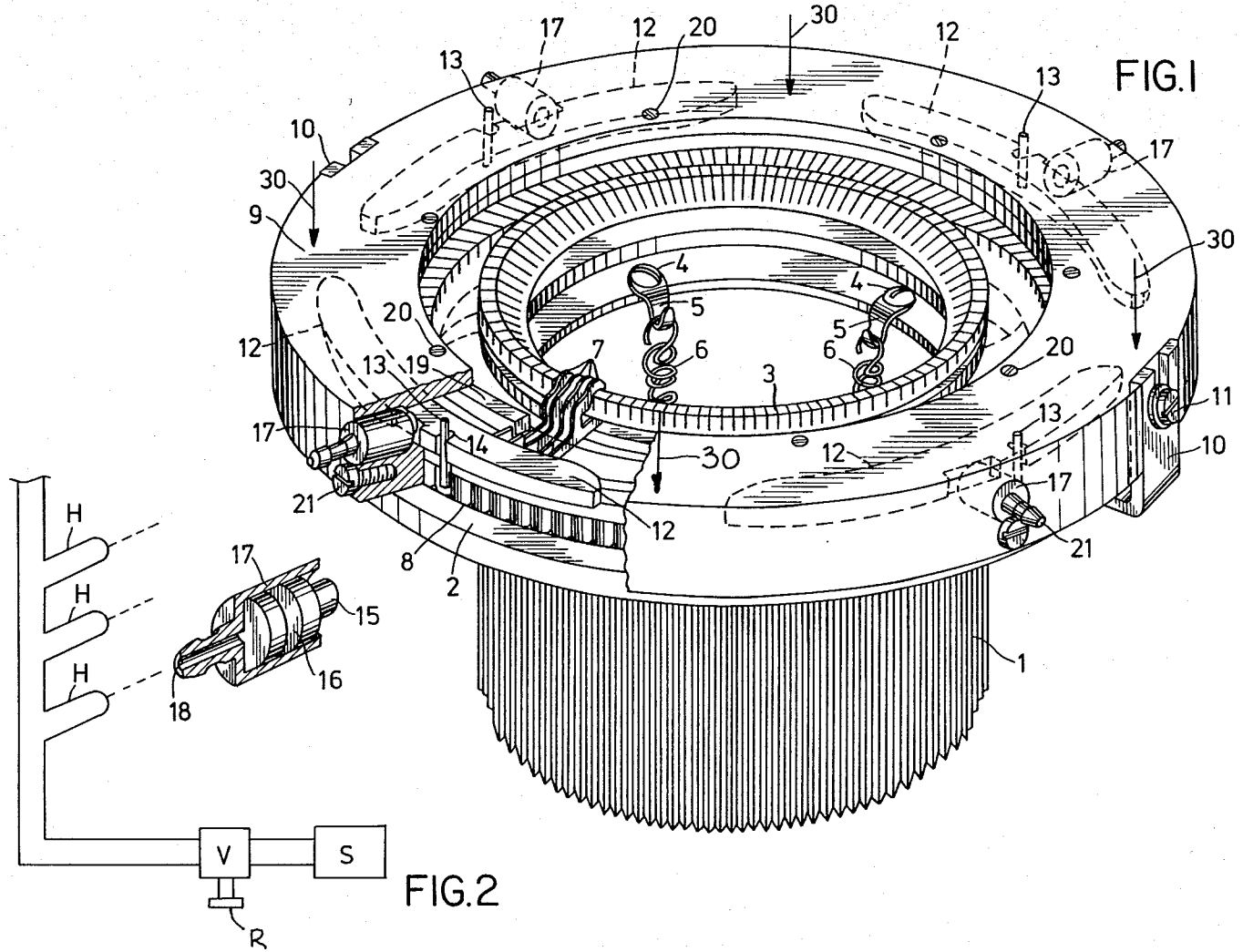

S
V
R
H
H
H

CIRCULAR KNITTING MACHINE FOR HOSIERY ARTICLES

This invention relates to a circular knitting machine for hosiery articles, especially for ladies' stockings, such a machine being conventionally equipped with sinker-pressing cams, and this invention particularly relates to a control device for such sinker-pressing cams.

The formation of the hosiery articles on the circular knitting machines takes place, as is well known, by means of needles with the coaction of sinkers, the former being mounted within needle-tricks formed through the needle cylinder, the latter being housed in radial sinker-tricks formed through an internal and an external ring, respectively, which are connected to said needle cylinder. Special cams compose the so called needle locks and the sinker locks, these cams are mounted in a sleeve which surrounds the needle cylinder and in a lid overlying said external ring, respectively, said locks being intended to impart to the needles and the sinkers, respectively, the synchronized movements which are required for the formation of the loops, while the needle cylinder and the rings connected to said cylinder are being rotated about their common axis.

The circular knitting machines in use nowadays for the manufacture of stockings have a number of points for supplying the yarns, that is, a plurality of the so-called "feeds" so that, at every revolution of the needle cylinder a number of loop courses are formed.

As the speed of revolution of the assembly composed of the needle cylinder and the sinker-carrying rings in a hosiery knitting machine is increased, especially in machines intended for the production of ladies' stockings, also on account of the present nearly universal demand for stockings of the panty-hose type to be produced with such machines, the circular knitting machines for hosiery have been equipped with specially provided cams to press the sinkers, said cams being mounted in the lid overlying the sinker-carrying outer ring in the spaces intermediate between any two adjacent individual "feeds", that is, in those areas in which the conventional cams of the sinker looks are not active. The task of such sinker-pressing cams is, in the main, to counteract the centrifugal forces which stress the sinkers so as to have the latter radially biassed towards the centre of the cylinder assembly. Whenever it is desired to produce panty-hoses, the sinker-pressing cams have, additionally, the task of urging the sinkers towards the centre so as to hold taut the part of the article of hosiery which has already been knitted, more particularly in the area of the panty portion wherein, due to the requirement of providing a broad-meshed texture, the absence of such cams might very likely cause the formed meshes to become clear of the sinker hooks, that which would originate imperfections in the finished article.

The sinker-pressing cams have a shape generally in the outline of a banana fruit and are housed in an annular race formed internally of the sinker lid. A helical spring, coiled so as to form a closed loop, surrounds such cams and urges them towards the centre of the machine.

The adoption of such sinker-pressing cams affords a number of considerable advantages, especially during certain stages of the production of stockings, but the shortcoming of the systems adopted heretofore is that it has a poor adaptability to several production requirements such as different rotational speeds, different counts of yarn, various mesh widths and the like, and in addition, it does not permit to render the sinker-pressing cams inoperative whenever they are not required, or their action is undesirable. As a matter of fact, inasmuch as the sinker-pressing cams subjected to the bias of a spring to be properly calibrated according to the individual requirements which occur from time to time, the spring should be replaced as the individual requirements are changed, or it should even be withdrawn, or the cams should be blocked in their inoperative positions, wherever it desired that the cams may not enter action.

An objective of the invention is thus to provide a circular hosiery knitting machine for stocking, equipped with sinker-pressing cams, in which it is possible to carry out an easy and convenient adjustment of the cam action according to the individual production requirements in order to obtain an optimum behaviour of the cams.

In order that such an objective may be achieved, according to the invention, every cam of the sinker-pressing kind has, associated therewith, a miniature pneumatic ram with a plunger adapted to act upon the respective cam so as to push it radially towards the centre of the machine and up to a stopping abutment, said miniature rams being connected in parallel together in a pneumatic circuitry which comprises a control valve and a pressure regulator.

By properly monitoring the pressure value of the compressed air acting upon the plungers of the miniature rams, it is possible to increase, to decrease or even to annul the thrust to be exerted by the sinker-pressing cams onto the sinkers without any necessity of replacing component parts, so that, no matter what the individual requirements are, an optimum behaviour of the sinker-pressing cams is obtained in every case.

The features of the invention will best be understood from the ensuing description of a possible embodiment as illustrated in the accompanying drawings, wherein:

FIG. 1 diagrammatically shows in an overall view, partly in section, the top portion of the needle cylinder with the sinker-carrying rings and the lid of a circular knitting machine for ladies' stockings, and FIG. 2 is a fragmentary close-up view, partly in perspective and partly in cross-section, of an embodiment of the miniature pneumatic ram and associated air supply for operating its plunger.

The needle cylinder 1 carries, secured to its top section, an outer ring, 2, and an inner ring 3: the latter is fastened to the needle cylinder by screws such as 4. These screws also latch hooks 5 for springs 6 which, conventionally, pull down the cylinder 1 during the mesh-adjusting stages.

Within radial slots of the rings 2 and 3, conventional sinkers 7 having the usual sinker heels are slidably mounted: only four of the them are shown in FIG. 1.

The outer ring 2 has, mounted thereover, a fixed lid 9 and a ring of rollers 8 is inserted, like a bearing, in a specially provided race formed through said outer ring 2. The lid 9 has, secured thereto by screws 11, tags 10 which clamp with a slight clearance, with their lower portion, the outer ring 2 so as to allow the rotation thereof together with the needle cylinder 1.

Within an annular race formed internally of the lid 9, sinker-pressing cams 12 are housed, the circumferential motion whereof is prevented by dowels 13 which are in fixed position relative to the lid 9 and are engaged in slots 14 of said cams 12 so as to allow radial floating displacements of such cams. It should be noted that the sinker-pressing cams 12 are arranged in the areas between one feeding point for the yarn and its next: in the example shown, four cams 12 have been illustrated, and several yarn feeding points have been denoted schematically in FIG. 1 by the arrows 30.

Every banana-shaped sinker-pressing cam 12 has, associated therewith, a miniature pneumatic ram 17 with a tubular fitting 18 in which there is mounted, in a sealtight manner by a rubber ring type O-ring 16 (see FIG. 2) a plunger 15 which extends toward and acts upon the outside on its relevant cam 12 so as to thrust the latter radially and centripetally. The cam 12, in its turn, is adapted to press on the heels of the sinkers 7 which are thus urged towards the centre of the machine until they abut a stop consisting of a radial cam 19 secured to the lid by screws 20.

The fittings 18 of the miniature pneumatic rams 17 receive hoses H (FIG. 2) which connect said rams in parallel to a control valve V and a pressure regulator R through which the miniature rams can be fed with compressed air coming from an appropriate sources. The miniature pneumatic rams 17 are housed in specially provided or recesses seatings in the lid 9 and are secured thereto by screws 21.

It is apparent that, by properly acting upon the control valve V and the pressure regulator R, it becomes possible to meter the pressure with which the plunger 15 act upon the sinker-pressing cams 12, and the latter, in their turn, act upon the sinker tails. It is thus possible to increase or to decrease at will the thrust of the cams 12 against the sinkers 7 and even to annul such thrust whenever it is desired to deactivate the cams 12. By so doing, the behaviour of the sinker-pressing cams can easily be adapted and optimized consistently with the individual requirements from time to time, such as speed of rotation, count of yarn, stitch length and others, without any necessity of replacing any component parts of the machine whatsoever.

It is understood that the miniature pneumatic rams can be secured to the sinker lid in any desired fashion, such as by mechanical fastening members, welding, cementing and other ways. It is likewise possible to form the miniature rams directly through the sinker lid.

I claim:

1. A circular hosiery knitting machine, more particular for ladies' stockings, having a needle cylinder, sinker-carrying rings secured to the top of said cylinder, and a lid overlying said rings, said lid housing outwardly of the sinkers in said rings, and in the intermediate areas between the individual points at which yarn is disposed to be fed, a plurality of sinker-pressing cams mounted to float radially beneath said lid and to be centripetally shiftable by means adapted selectively to urge said cams toward heels on the sinkers, and characterized in that said urging means comprises a plurality of miniature pneumatic rams each with an attendant plunger, each of said sinker-pressing cams having, associated therewith, a ram and its attendent plunger, which is engagable with the last-named cam, said rams being connected in parallel together in a pneumatic circuitry comprising a control valve and a pressure regulator selectively for supplying air under pressure to said rams.

2. A circular hosiery knitting machine according to claim 1, characterized in that said miniature pneumatic rams are secured in recesses in said lid with their plungers extending through the lid toward said cams.

3. A circular hosiery knitting machine according to claim 1, characterized in that the miniature pneumatic rams pass directly through the sinker lid.

4. A circular hosiery knitting machine according to claim 1, characterized in that each miniature ram is fitted with a fitting for attachment to a flexible tube for connection to said circuitry.

5. A circular hosiery knitting machine according to claim 1, including means mounting said cam beneath said lid both for limited radial movement, and for limited pivotal movement about a stationary axis extending parallel to the axis of the needle cylinder.

* * * * *